US005754117A

United States Patent [19]

Inamori et al.

[11] Patent Number: 5,754,117

[45] Date of Patent: May 19, 1998

[54] REMOTE CONTROL DEVICE FOR AUTOMOTIVE VEHICLE

[75] Inventors: Nobuya Inamori; Kiyotaka Naitou; Yoshikazu Taniguchi, all of Yokkaichi, Japan

[73] Assignee: Sumitomo Wiring Systems, Ltd., Japan

[21] Appl. No.: 425,368

[22] Filed: Apr. 20, 1995

[30] Foreign Application Priority Data

May 16, 1994 [JP] Japan ..... 6-101213

[51] Int. Cl.[6] ..... G08C 19/00; G60B 1/00; B08Q 1/08; G08G 1/01

[52] U.S. Cl. ..... 340/825.72; 340/825.72; 340/825.69; 340/425.5; 340/953; 455/539

[58] Field of Search ..... 340/825.69, 825.72, 340/539, 825.56, 426, 458, 461; 341/176; 359/142, 145; 361/807.8, 807.9, 814; 455/346; 180/333; 307/108

[56] References Cited

U.S. PATENT DOCUMENTS 4,241,870 12/1980 Marcus ..... 296/37.7
4,631,640 12/1986 Umetsu et al. ..... 361/422

FOREIGN PATENT DOCUMENTS 2-159900 6/1990 Japan .
3-20994 1/1991 Japan ..... H05B 37/02
4-5789 1/1992 Japan ..... H04Q 9/00
4-88623 7/1992 Japan ..... H01H 13/02
5-22783 1/1993 Japan ..... H04Q 9/00

OTHER PUBLICATIONS

Patent Abstract of Japan JP61054337 Mar. 18, 1986, vol. 010,#216 JP-U-00 05-4385, pp. 357-359.
Patent Abstracts of Japan JP5014978 Jan. 22, 1993, vol. 017, 190 289.

*Primary Examiner*—Nimeshkumar Patel
*Assistant Examiner*—Anthony A. Asongwed
*Attorney, Agent, or Firm*—Jordan B. Bierman; Bierman, Muserlian and Lucas LLP

[57] ABSTRACT

A remote control device for an automotive vehicle wherein a transmitter (10) is received in a holder (2), with side-marker lights and taillights staying on, to connect holder-side contacts (3, 4) to transmitter-side contacts (16, 17), and the transmitter (10) is removed from the holder (2) to disconnect the transmitter-side contacts (16, 17) from the holder-side contacts (3, 4). A differentiating circuit (21) detects the disconnection of the transmitter-side contacts (16, 17) from the holder-side contacts (3, 4) by the removal of the transmitter (10) in the on position of the side-marker lights and taillights, and a timer (22) clocks a predetermined timer time over which LEDs illuminate manipulation keys (12) of the transmitter (10). Only the removal of the remote control transmitter from the holder permits the manipulation keys to be readily illuminated.

9 Claims, 8 Drawing Sheets

REMOTE CONTROL DEVICE FOR AUTOMOTIVE VEHICLE

BACKGROUND OF THE INVENTION

1. Field of the Invention

The present invention relates to a remote control device for an automotive vehicle which includes a remote control transmitter removably mounted in a holder within a vehicular cabin and having a plurality of manipulation keys for transmitting remote control signals corresponding to the respective manipulation keys to a receiver of a vehicle-mounted electrical equipment such as an air conditioner and an audio equipment.

2. Description of the Prior Art

Various types of remote control devices have been devised for vehicle-mounted electrical equipments in the past. For example, Japanese Patent Publication No. 5-57938 (1993) discloses a remote control device wherein only the removal of a remote control transmitter from a holder during a vehicle run in the dark allows a dome light to go on to illuminate the remote control transmitter by using a combination of a first switch which is turned on and off when the remote control transmitter is removed from and received in the holder and a second switch such as a taillight switch which is turned on and off depending on the brightness in the cabin. Japanese Utility Model Publication No. 5-4385 (1993) discloses a remote control device wherein, for illuminating a remote control transmitter for a vehicle-mounted equipment such as an air conditioner and an audio equipment, the transmitter includes an illumination means and an illumination switch which is operated to drive the illumination means for lighting to illuminate manipulation keys of the remote control transmitter.

Japanese Patent Application Laid-Open No. 5-14978 (1993) discloses a remote control device, although not for automotive vehicles. In the remote control device, when a remote control transmitter is mounted in a normal place, a normal place illuminating light is turned on and a photocurrent generated by a solar cell charges a storage battery. When the remote control transmitter is out of the normal place, the normal place illuminating light is turned off. When a photodetecting means such as a phototransistor detects a dark level around the remote control transmitter which is out of the normal place, light emitting means such as LEDs (light emitting diodes) supplied with a drive voltage from the solar cell and the storage battery illuminate from inside and display transparent patterns indicative of the functions of instruction keys formed on the surface of a box-shaped body of the remote control transmitter for visual recognition of the positions of the instruction keys.

The above described prior art remote control devices, however, have drawbacks to be described below. The device disclosed in Japanese Patent Publication No. 5-57938 wherein the dome light turned on during the vehicle run presents a problem in terms of safety, and is disadvantageous in that the dome light staying on allows the vehicle interior to be readily seen from the exterior. In the device disclosed in Japanese Utility Model Publication No. 5-4385, the illumination switch of the transmitter must be necessarily pushed, and pressing of another manipulation key by mistake or accidental pressing of the illumination switch might waste the built-in battery of the transmitter. The device disclosed in Japanese Patent Application Laid-Open No. 5-14978 is of complicated construction since the brightness is detected by the photodetecting means such as the phototransistor, and the remote control transmitter left removed from the normal place in the dark causes the storage battery to be wasted, which might result in the device failing to operate for a night run in need.

SUMMARY OF THE INVENTION

The present invention is intended for a remote control device for an automotive vehicle having a holder placed in a vehicular cabin and a remote control transmitter adapted to be freely received in and removed from the holder, the remote control transmitter having a plurality of manipulation keys and functioning to transmit a remote control signal corresponding to one of the manipulation keys which is manipulated to a receiver of a vehicle-mounted electrical equipment. According to the present invention, the remote control device comprises: a holder-side contact in the holder and connected to an automotive battery when a night-driving lamp to be lit for night driving of the automotive vehicle is turned on; a transmitter-side contact in the remote control transmitter, the transmitter-side contact being connected to the holder-side contact by fitting the remote control transmitter in the holder, the transmitter-side contact being disconnected from the holder-side contact by removing the remote control transmitter from the holder; detector in the remote control transmitter for detecting disconnection of the transmitter-side contact from the holder-side contact to output a detection signal; a timer in the remote control transmitter for clocking a predetermined timer time in response to the detection signal; light emitting elements in the remote control transmitter for individually illuminating the manipulation keys; a drive circuit in the remote control transmitter and operated during operation of the timer for driving the light emitting elements for lighting; and a built-in power supply in the remote control transmitter for supplying power to at least the light emitting elements, the timer and the drive circuit.

As above described, according to the present invention, the connection between the transmitter-side contact and the holder-side contact is broken by removing the remote control transmitter from the holder when the night-driving lamp is on. The detecting means detects the disconnection to operate the timer, and the light emitting elements are driven by the drive circuit for lightning during the operation of the timer. Thus only the setting of the holder within the driver's reach, for example on the center console, in the vehicular cabin allows the removal of the remote control transmitter from the holder to light the light emitting elements for the predetermined timer time to illuminate the manipulation keys. This eliminates the conventional driving trouble such as the illumination of the entire cabin interior during a vehicle run, to ensure safety for night driving.

Preferably, when the night-driving lamp is lit, the automotive battery supplies power to at least the timer and the drive circuit, with the remote control transmitter received in the holder, and the built-in power supply supplies power to at least the light emitting elements, the timer and the drive circuit, with the remote control transmitter removed from the holder.

When the night-driving lamp is on, the automotive battery supplies power to the respective portions of the remote control transmitter, with the remote control transmitter in the retained position, and the built-in battery supplies power to the light emitting elements and the respective portions of the remote control transmitter, with the remote control transmitter in the removed position. This reduces the amount of waste of the built-in battery.

Preferably, the detecting means includes a differentiating circuit.

The use of the differentiating circuit as the detecting means simplifies the construction of the detecting means, achieving the detection of the removal of the remote control transmitter with simple construction.

It is therefore an object of the present invention to provide a remote control device for an automotive vehicle which is capable of readily illuminating manipulation keys only by removing a remote control transmitter from a holder with a small amount of built-in battery waste.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 2:
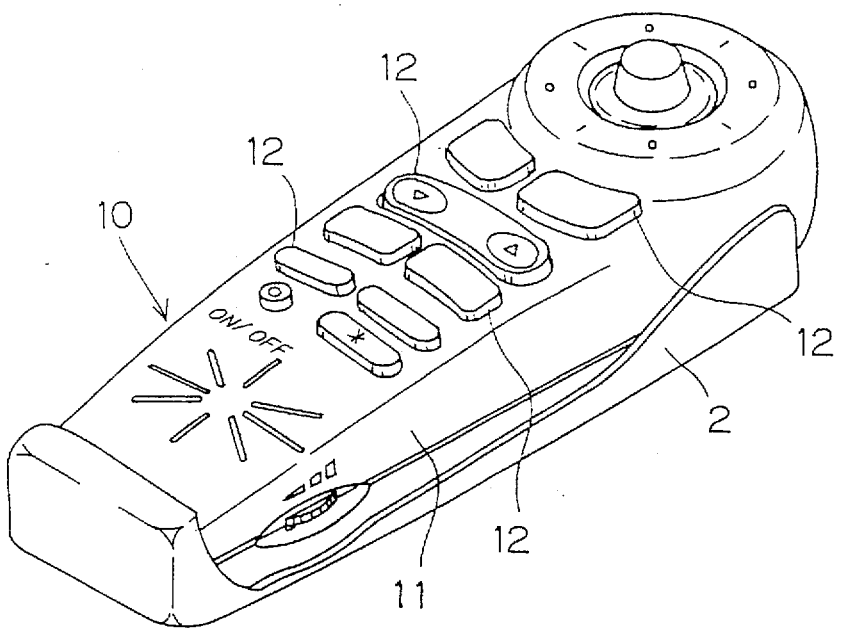
FIG. 2 is an outside perspective view of the first preferred embodiment in one position.
Figure 3:
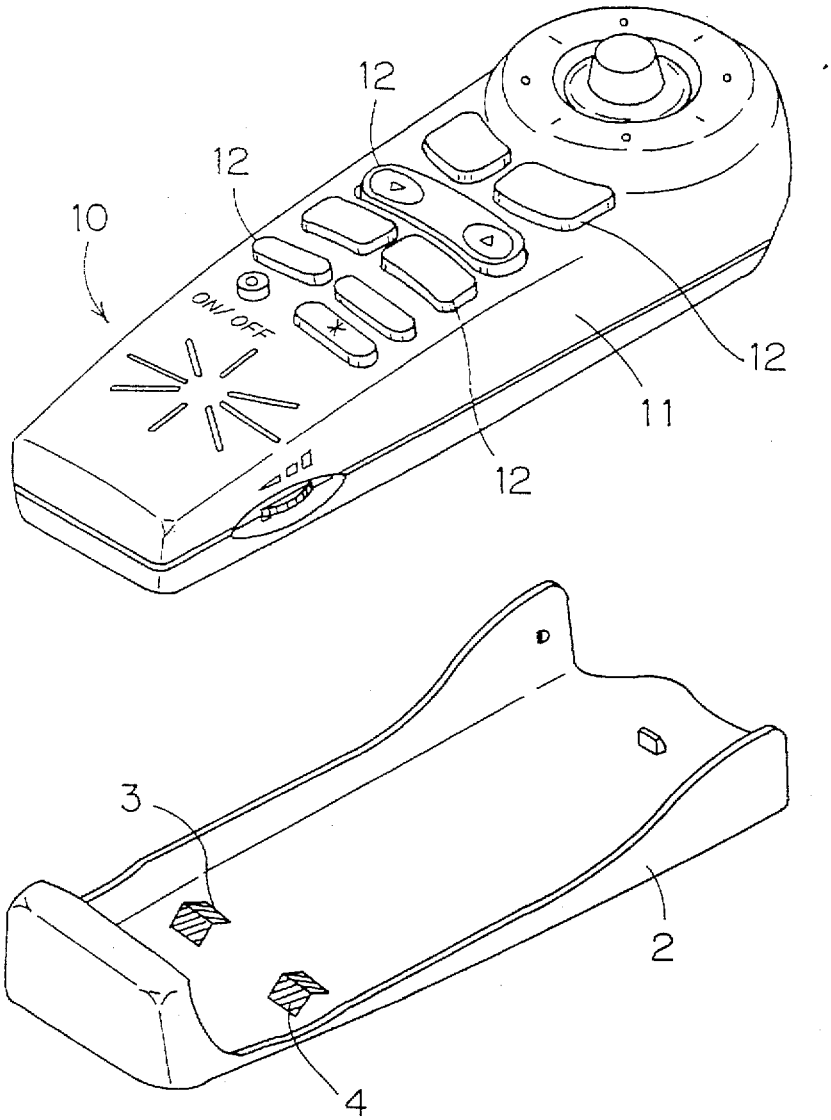
FIG. 3 is an outside perspective view of the first preferred embodiment in another position.
Figure 5:
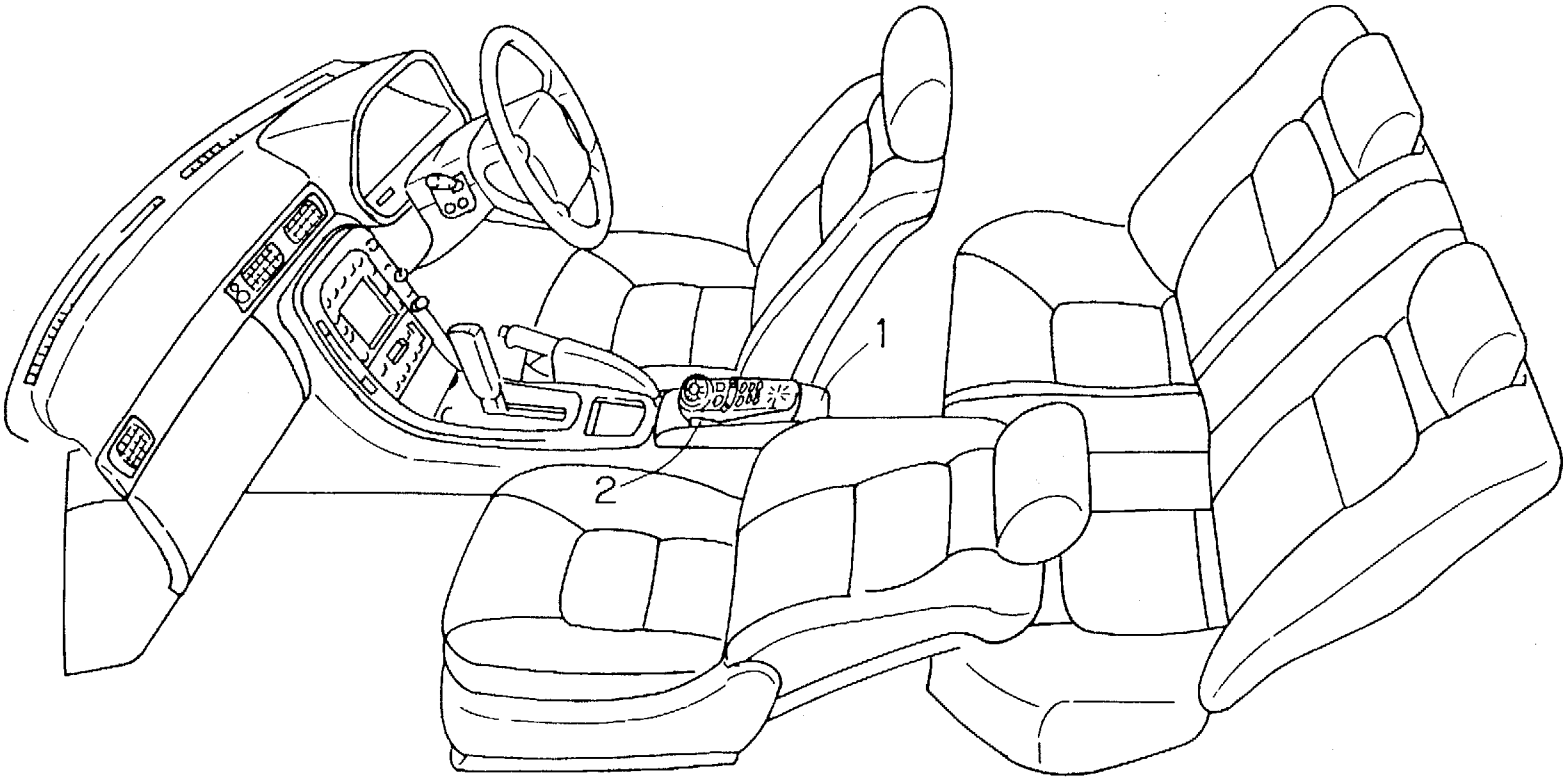
FIG. 5 illustrates the arrangement of the first preferred embodiment.

Referring first to FIG. 5, there is shown an outside view of a remote control device for an automotive vehicle wherein a holder 2 is placed on a center console 1 within the vehicular cabin. Referring to FIG. 3, the holder 2 includes a pair of projecting holder-side contacts 3, 4 connected to an automotive battery (not shown) through a sub-switch which is turned on in response to the turning on of a main switch for lighting lamps for night driving to be described later. A remote control transmitter (referred to simply as a transmitter hereinafter) 10 is adapted to be received in and removed from the holder 2 as shown in FIGS. 2 and 3.

With continued reference to FIGS. 2 and 3, a plurality of manipulation keys 12 inside which are disposed light emitting diodes (referred to hereinafter as LEDs) serving as light emitting elements are arranged on the top surface of a case 11 of the transmitter 10. Holes for receiving the holder-side contacts 3, 4 are formed in a lower surface of the case 11 opposed to the holder-side contacts 3, 4 when the transmitter 10 is received in the holder 2, and transmitter-side contacts are provided inside the holes. The transmitter-side contacts come in contact with the holder-side contacts 3, 4, respectively, when the holder 2 receives the transmitter 10.

Figure 4:
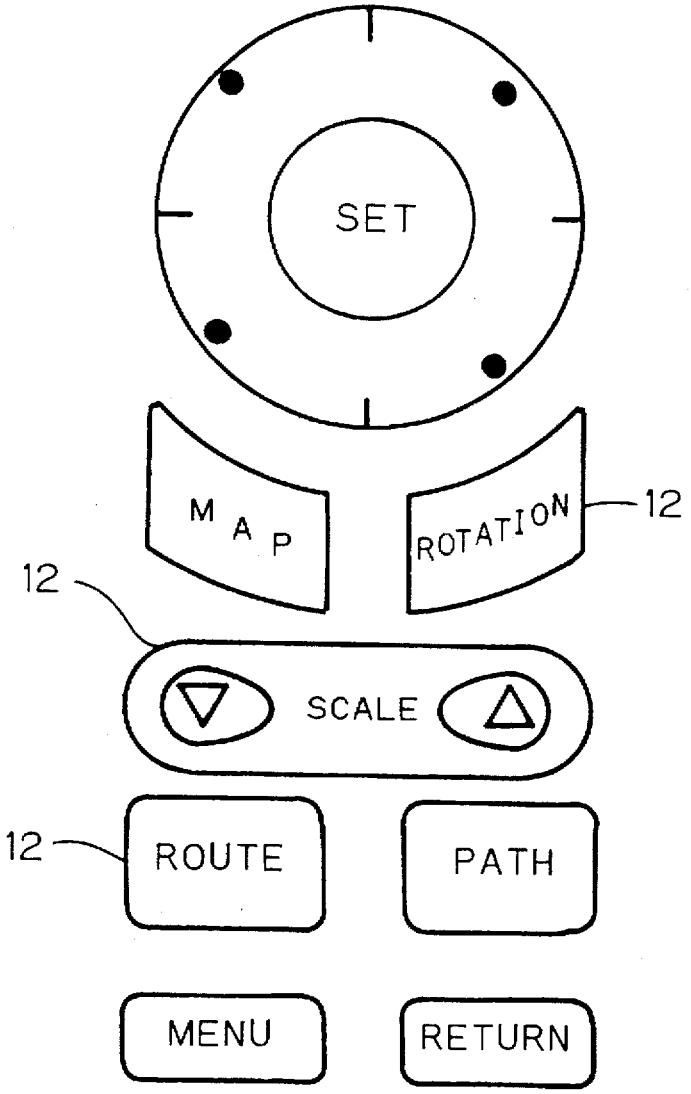
FIG. 4 is a fragmentary plan view of the first preferred embodiment.

Each of the manipulation keys 12 of the transmitter 10 similar to the general keys is made of transparent or translucent resin. Characters and marks indicative of the respective key functions as shown in FIG. 4 are displayed on the top surface of the manipulation keys 12. The LEDs are disposed inside the manipulation keys 12.

The construction of the transmitter 10 will be described below.

Figure 1:
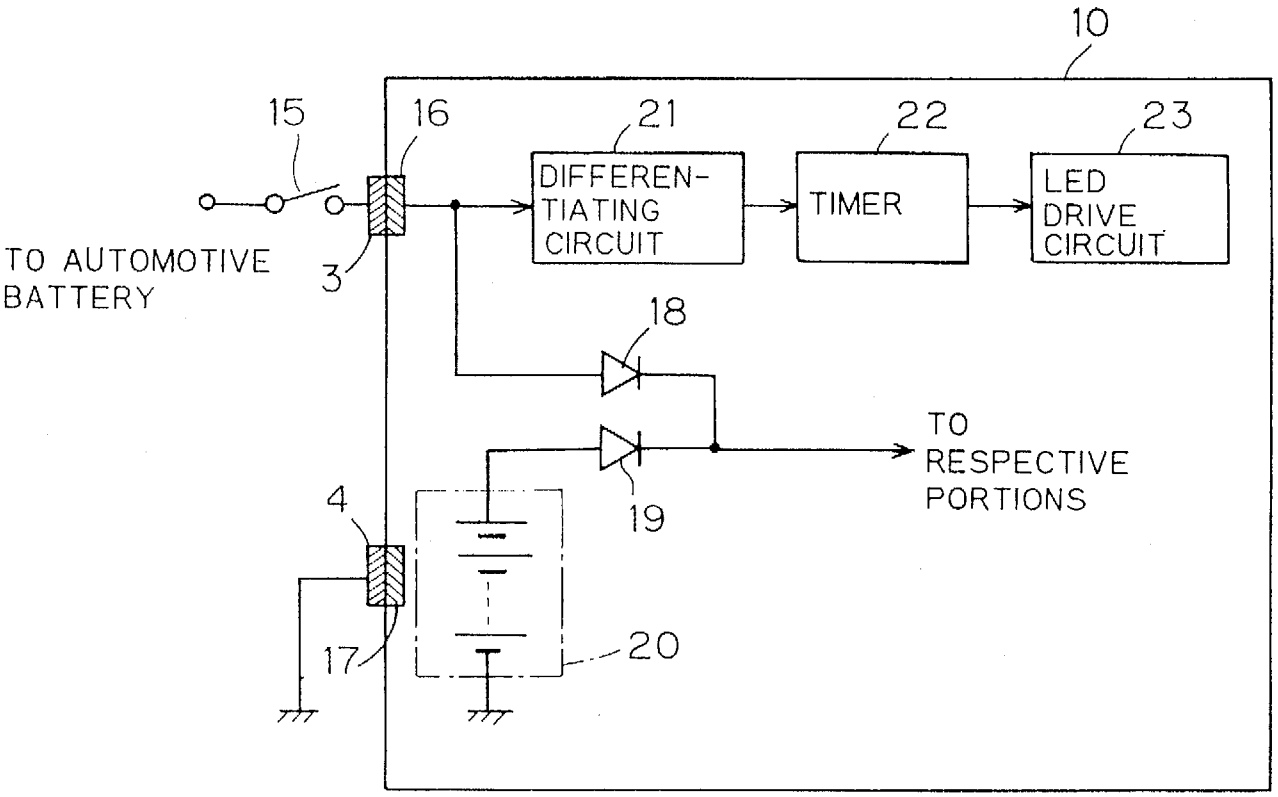
FIG. 1 is a block diagram of a first preferred embodiment according to the present invention.

Referring to FIG. 1, the holder-side contact 3 is connected to the automotive battery through the sub-switch 15 responsive to the main switch (not shown) for turning on side-marker lights and taillights for night driving, and the holder-side contact 4 is grounded. Fitting the transmitter 10 in the holder 2 allows the transmitter-side contacts 16, 17 to be electrically connected to the holder-side contacts 3, 4, respectively.

With the transmitter 10 in the retained position and the sub-switch 15 in the on position, power is fed to respective portions of the transmitter 10 from the automotive battery and a dry cell 20 serving as a built-in power supply through reverse blocking diodes 18, 19, respectively. In this case, power is mainly fed from the automotive battery. When the transmitter 10 is removed from the holder 2 in this state, the connection is broken between the transmitter-side contacts 16, 17 and the holder-side contacts 3, 4, and power supply to the respective portions of the transmitter 10 from the automotive battery is interrupted whereas the power supply from the dry cell 20 continues. At the same time, disconnection of the contacts 16, 17 from the contacts 3, 4 causes an input to a differentiating circuit 21 serving as a detector to go low, and the differentiating circuit 21 detects the falling edge to provide a trigger pulse, or a detection signal, to a timer 22 in the following stage. Then the timer 22 starts operating to clock a predetermined timer time. The LEDs are driven by an LED drive circuit 23 for lighting during the operation of the timer 22 to illuminate the manipulation keys 12 for the predetermined timer time.

In the daytime, since the side-marker lights and the taillights are not turned on and the sub-switch 15 remains off, the LEDs of the manipulation keys 12 are not lit to prevent the dry cell 20 from being wasted.

The provision of the holder 2 on the center console 1 in the cabin within easy reach of a driver enables only the removal of the transmitter 10 from the holder 2 to light the LEDs for the predetermined timer time to illuminate the manipulation keys 12. This prevents such a conventional problem that the entire cabin interior is illuminated during a vehicle run, and ensures safety for night driving.

Further, with the transmitter 10 in the retained position and the sub-switch 15 in the on position in response to the turning on of the side-marker lights and the taillights, power is fed to the respective portions of the transmitter 10 mainly from the automotive battery. When the transmitter 10 is removed in this state, the dry cell 20 in the transmitter 10 supplies power. This reduces the amount of waste of the dry cell 20.

A second preferred embodiment will be discussed below according to the present invention.

Figure 6:
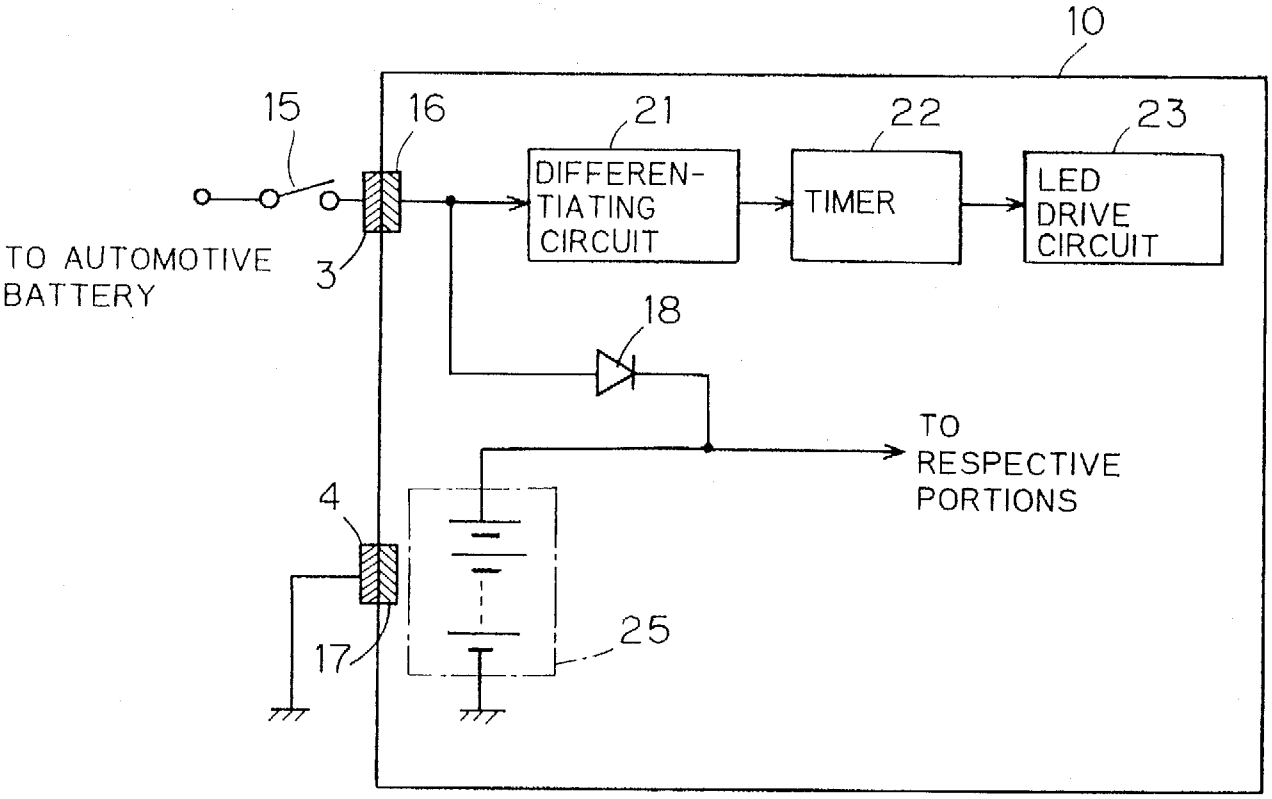
FIG. 6 is a block diagram of a second preferred embodiment according to the present invention.

FIG. 6 is a block diagram of the second preferred embodiment according to the present invention. In FIG. 6, like reference numerals are used to designate elements identical with or corresponding to those of FIG. 1. The second preferred embodiment of FIG. 6 differs from the first preferred embodiment of FIG. 1 in that the reverse blocking diode 19 is not provided and the dry cell 20 is replaced with a storage battery 25 as a built-in power supply charged by the automotive battery.

With the transmitter 10 in the retained position and the sub-switch 15 in the on position in response to the turning on of the side-marker lights and the taillights, power is fed to the respective portions of the transmitter 10 from the automotive battery and the storage battery 25 is charged.

When the transmitter 10 is removed in this state, the storage battery 25 supplies power. This minimizes the amount of waste of the storage battery 25.

Figure 7A:
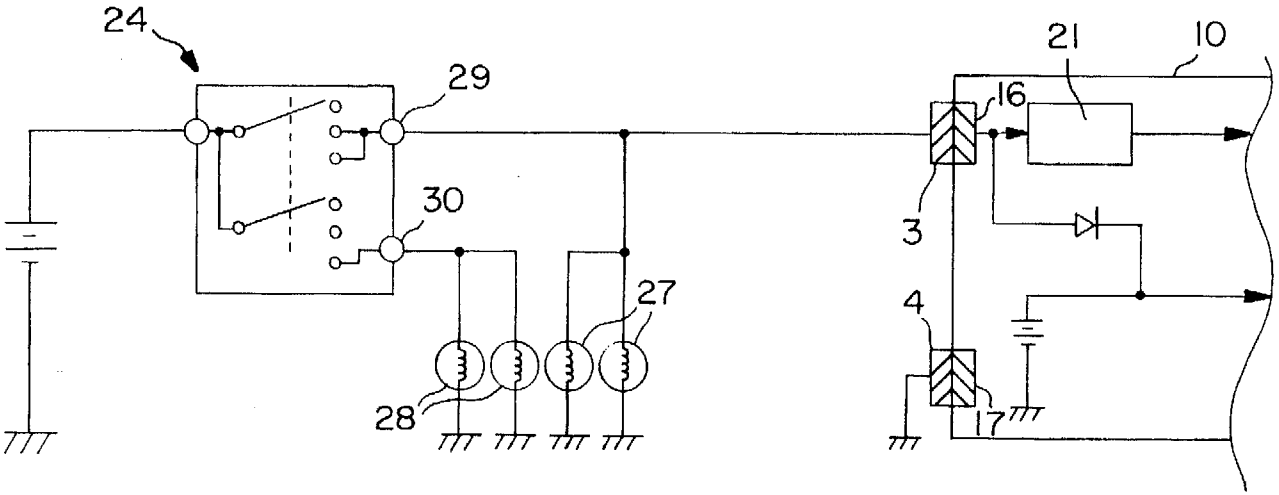
FIG. 7A is a diagrammatic representation of the overall circuitry of the present Invention, wherein the sub-switch and the main switch are the same.
Figure 7B:
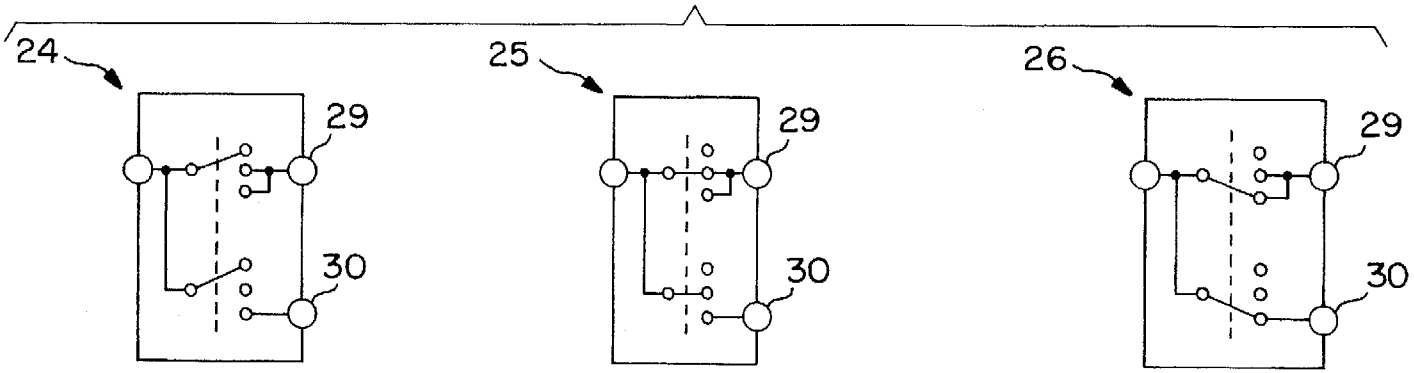
FIG. 7B is a series of schematic representations of the switch in its three positions.

FIGS. 7A and 7B show a form of the present Invention wherein the main switch also functions as the sub-switch. The overall circuitry is shown in FIG. 7A with differentiating circuit 21. The main switch is in its off position as shown at 24. No current is flowing to contact 29 and hence to side-marker and tail lights 27. Similarly, no current reaches contact 30 and headlights 28 are unlit.

In FIG. 7B, the off position of the main switch is shown at 24. At 25, the switch is in its partly on position. Current flows to contact 29 and hence to side-marker and tail lights 27. However, contact 30 is not energized and headlights 28 are not lit.

At 26, the main switch is shown in it s fully on position. Both contact s 29 and 30 are energized and headlights 28 and side-marker and tail lights 27 are illuminated.

When the main switch is in off position 24, the Invention treats the transmitter as if it were removed from the holder. The battery in the transmitter interacts with the timer and feeds power to the transmitter circuitry for a limited period of time, after which it is turned off.

Figure 8:
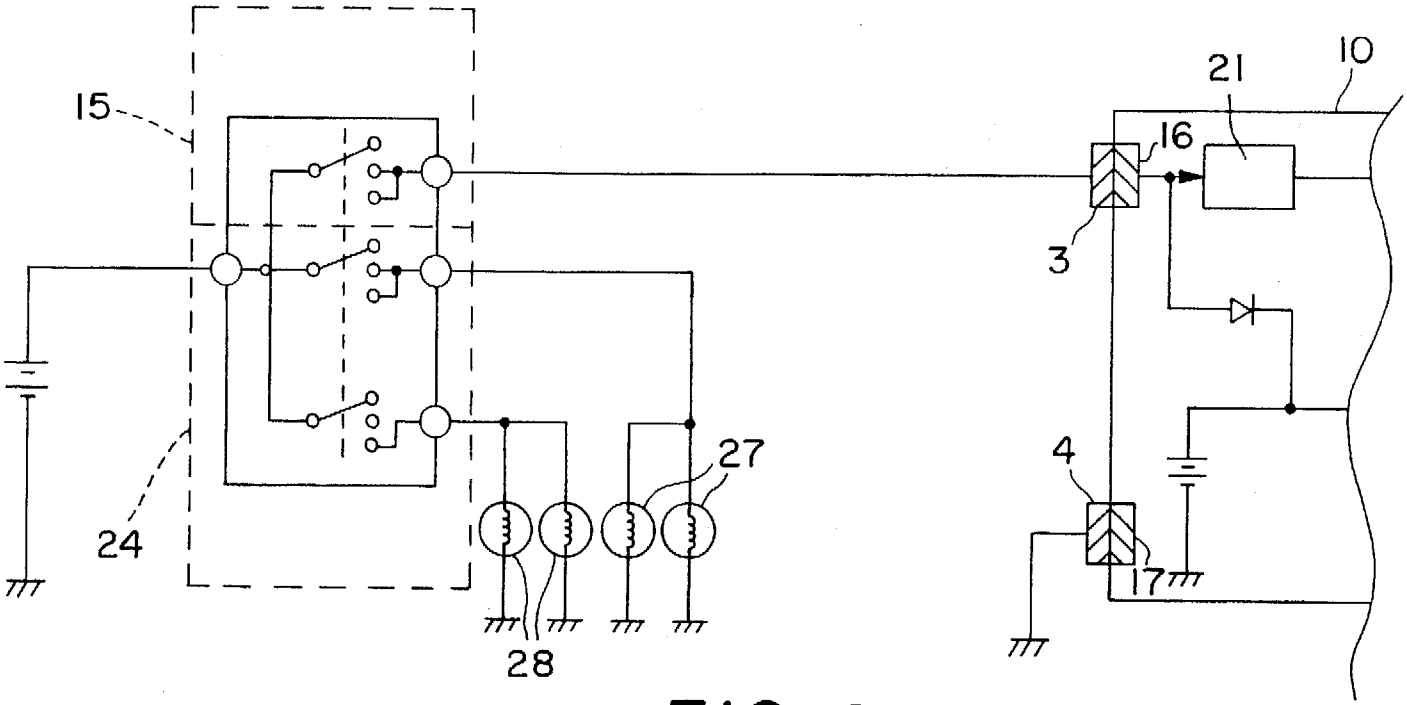
FIG. 8 is similar to FIG. 7A wherein there is a sub-switch separate from the main switch.

In FIG. 8, sub-switch 15 is separate from the main switch and the differentiating circuit is shown at 21. As shown, the main switch is in off position 24 so that neither contact 29 nor contact 30 is energized. Hence, all lights 27 and 28 are not lit.

Sub-switch 15 acts in concert with the main switch, making and breaking the connection between the battery and the transmitter. Since the sub-switch moves with the main switch, it will also have the same three positions. Therefore, there are two contacts in the sub-switch which lead to the transmitter, one when the switches are activating the side and tail lights only, and the other when the headlights are activated.

The time clocked by the timer 22 is not limited to a specific value but may be a time which requires a user to sufficiently recognize the control keys 12 of the transmitter 10.

The light emitting elements are not limited to the LEDs but may be electroluminescence elements and the like.

The detector is not limited to the differentiating circuit 21.

The holder 2 need not be placed on the center console 1 but may be within the reach of a driver or other vehicle occupants.

While the invention has been shown and described in detail, the foregoing description is in all aspects illustrative and not restrictive. It is therefore understood that numerous modifications and variations can be devised without departing from the scope of the invention.

What is claimed is:

1. A remote control device for an automotive vehicle having a holder placed in a vehicular cabin and a remote control transmitter adapted to be freely received in and removed from said holder, said remote control transmitter having a plurality of manipulation keys and functioning to transmit a remote control signal corresponding to one of said manipulation keys which is manipulated to a receiver of a vehicle-mounted electrical equipment, said remote control device comprising:

a holder-side contact in said holder and connected to an automotive battery when a night-driving lamp to be lit for night driving of the automotive vehicle is turned on;

a transmitter-side contact in said remote control transmitter, said transmitter-side contact being connected to said holder-side contact by fitting said remote control transmitter in said holder, said transmitter-side contact being disconnected from said holder-side contact by removing said remote control transmitter from said holder;

detector in said remote control transmitter for detecting disconnection of said transmitter-side contact from said holder-side contact to output a detection signal;

a timer in said remote control transmitter for clocking a predetermined timer time in response to said detection signal;

light emitting elements in said remote control transmitter for individually illuminating said manipulation keys;

a drive circuit in said remote control transmitter and operated during operation of said timer for driving said light emitting elements for lighting; and a built-in power supply in said remote control transmitter for supplying power to at least said light emitting elements, said timer and said drive circuit.

2. The remote control device of claim 1, wherein said built-in power supply includes a storage battery charged by said automotive battery when said remote control transmitter is received in said holder.

3. The remote control device of claim 1, wherein said built-in power supply includes a primary battery.

4. The remote control device of claim 1, wherein when said night-driving lamp is lit, said automotive battery supplies power to at least said timer and said drive circuit, with said remote control transmitter received in said holder, and said built-in power supply supplies power to at least said light emitting elements, said timer and said drive circuit, with said remote control transmitter removed from said holder.

5. The remote control device of claim 1, wherein said detector includes a differentiating circuit.

6. The remote control device of claim 2, wherein when said night-driving lamp is lit, said automotive battery supplies power to at least said timer and said drive circuit, with said remote control transmitter received in said holder, and said built-in power supply supplies power to at least said light emitting elements, said timer and said drive circuit, with said remote control transmitter removed from said holder.

7. The remote control device of claim 3, wherein when said night-driving lamp is lit, said automotive battery supplies power to at least said timer and said drive circuit, with said remote control transmitter received in said holder, and said built-in power supply supplies power to at least said light emitting elements, said timer and said drive circuit, with said remote control transmitter removed from said holder.

8. The remote control device of claim 2, wherein said detector includes a differentiating circuit.

9. The remote control device of claim 3, wherein said detector includes a differentiating circuit.

* * * * *